United States Patent [19]

Toyomi et al.

[11] 4,430,808

[45] Feb. 14, 1984

[54] HAIR DRYER

[75] Inventors: Yuritsugu Toyomi; Yukio Wada, both of Shiga, Japan

[73] Assignee: Matsushita Electric Works, Ltd., Kadoma, Japan

[21] Appl. No.: 369,795

[22] Filed: Apr. 19, 1982

[30] Foreign Application Priority Data

Apr. 30, 1981 [JP] Japan ..... 56-67209

[51] Int. Cl.[3] ..... A45D 20/50

[52] U.S. Cl. ..... 34/97; 34/101; 132/116; 219/373

[58] Field of Search ..... 132/7, 9, 11, 112, 113, 132/114, 116; 34/97, 101, 98; 219/373, 222

[56] References Cited

U.S. PATENT DOCUMENTS 4,365,426 12/1982 Suzuki et al. ..... 34/101

FOREIGN PATENT DOCUMENTS 1519042 7/1978 United Kingdom .

*Primary Examiner*—Larry I. Schwartz

*Attorney, Agent, or Firm*—Stevens, Davis, Miller & Mosher

[57] ABSTRACT

A hair dryer is provided with a hot air vent for preventing excessive rises in the air temperature of its hair-winding attachment. This vent is in addition to the air blowing holes of the hair-winding attachment for drying the hair. The dryer includes a temperature-sensitive valve for opening the hot air vent at a predetermined abnormal air temperature in the hair-winding attachment to prevent an excessive rise in temperature of the air in the hair-winding attachment which may damage the hair or the dryer body.

8 Claims, 11 Drawing Figures

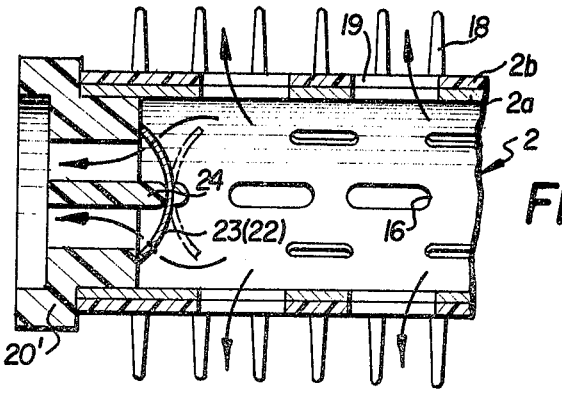
FIG. 9
FIG. 10
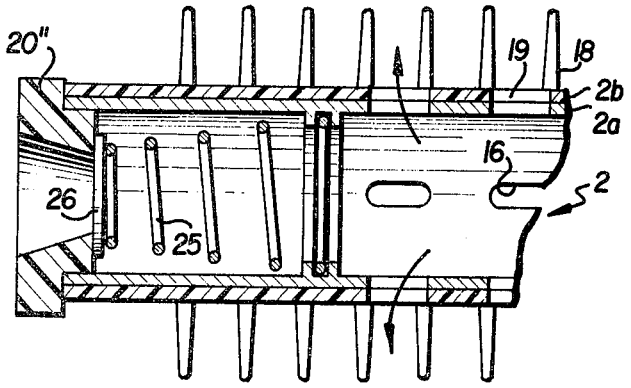
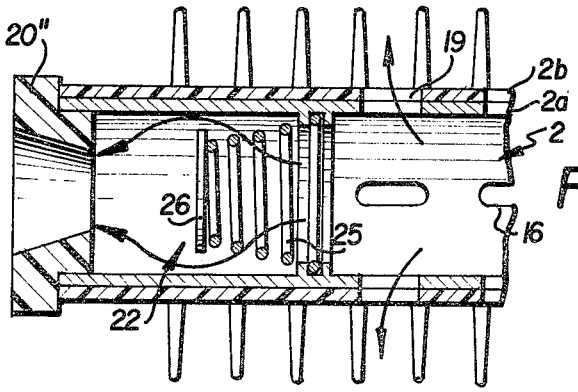
FIG. 11

HAIR DRYER

BACKGROUND OF THE INVENTION

This invention relates to hair dryers, particularly electric hair dryers of the hand-held type.

Electric hair dryers of the hand-held type are generally known and often include a hollow cylindrical hair-winding attachment having air blowing holes disposed along its length. Hair may be wound around the exterior of the hair-winding attachment and dried by hot air blown out through the air blowing holes. However, when a large quantity of hair is wound around such a hair-winding attachment or when the temperature of the ambient atmosphere is high, the temperature of the hot air being blown out through the air blowing holes may become excessively high and damage the hair wound around the hair-winding attachment or deform the hair-winding attachment or dryer body, which may, for example, be of plastic materials.

SUMMARY OF THE INVENTION

An object of the claimed invention is to provide a hair dryer having a hair-winding attachment provided with means to ensure that excessively hot air is not blown out through the air blowing holes of the hair-winding attachment. This is accomplished by means to detect hot air in the hair-winding attachment which is approaching an excessive temperature and to vent that hot-air from the hair dryer through a hot air vent. The hot air vent is controlled by a valve which opens when the air in the hair-winding attachment of the dryer rises to a predetermined abnormal temperature which is less than that of any excessive temperature. The temperature-sensitive means to actuate the valve may sense temperature indirectly or directly. An indirect temperature-sensitive valve actuating means may comprise, for example, a means in which the valve is biased in its closed position (closing the hot air vent) by a spring. The valve is opened by air pressure sensitive means acting against the force of the spring when the air pressure within the hair dryer rises to a level associated with the predetermined abnormal temperature. In a direct system, the valve is actuated by a solenoid or other means which includes means for directly sensing the air temperature in the hair dryer.

BRIEF DESCRIPTION OF THE DRAWINGS

FIG. 9 is a partial side view, in cross-section, of the tip portion of the hair-winding attachment for a second embodiment of the hair dryer of the claimed invention;

FIG. 10 is a partial side view, in cross-section, of the tip portion of the hair-winding attachment for a third embodiment of the hair dryer of the claimed invention, showing the valve thereof in its closed position;

FIG. 11 is a partial side view, in cross-section, of the tip portion of the hair-winding attachment for the third embodiment of the hair dryer of the claimed invention, showing the valve thereof in its open position.

DETAILED DESCRIPTION OF THE INVENTION

Figure 1:
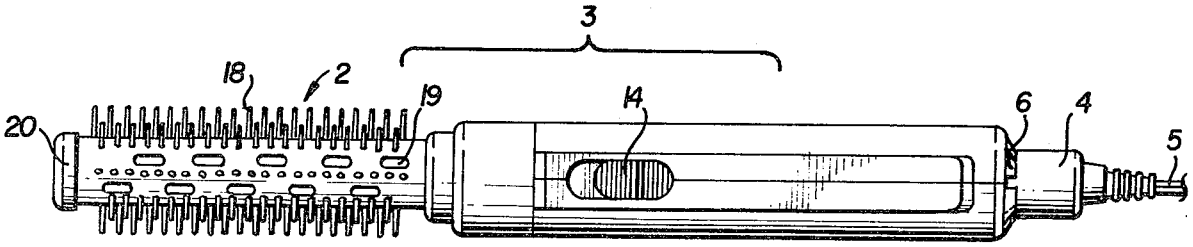
FIG. 1 is a side elevational view of a first embodiment of the hair dryer of the claimed invention.
Figure 2:
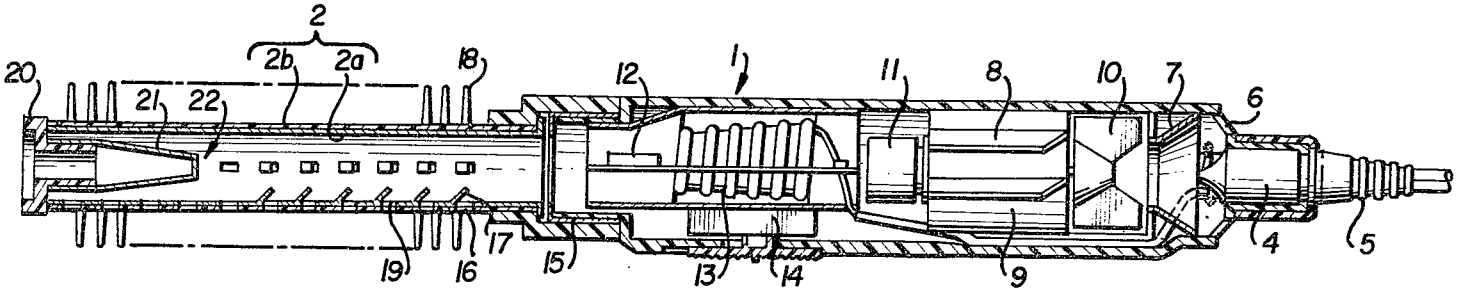
FIG. 2 is a side view, in cross-section, of the hair dryer illustrated in FIG. 1.
Figure 3:
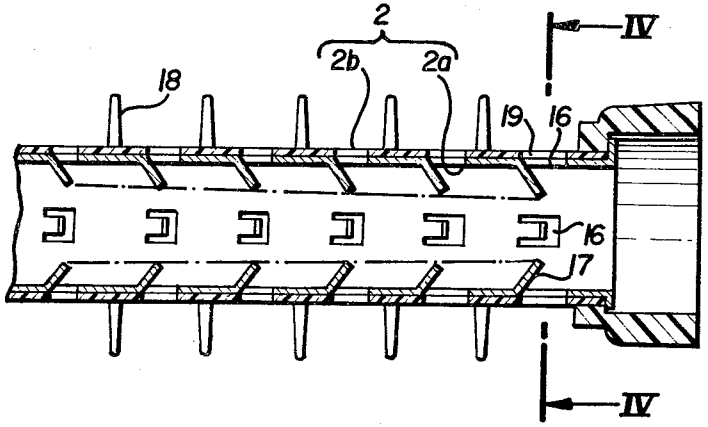
FIG. 3 is partial side view, in cross-section, of the hair dryer illustrated in FIG. 1, detailing certain portions of the hair-winding attachment thereof.
Figure 4:
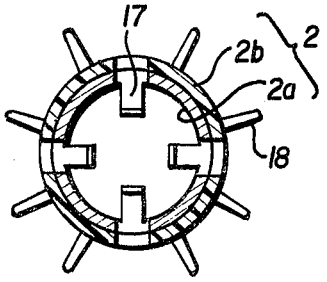
FIG. 4 is a view, in cross-section, of the hair-winding attachment illustrated in FIG. 3, taken along the line IV—IV.
Figure 5:
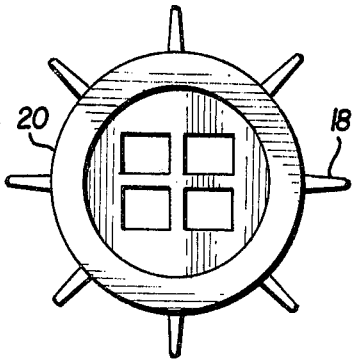
FIG. 5 is a front elevational view of the hair dryer illustrated in FIG. 1 showing the tip of the hair-winding attachment.
Figure 6:
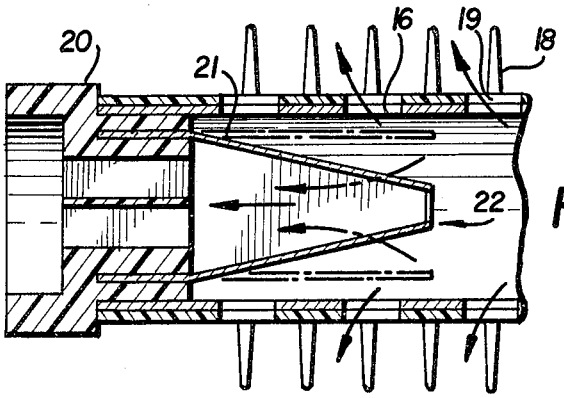
FIG. 6 is a partial side view, in cross-section, of the tip portion of the hair-winding attachment of the hair dryer illustrated in FIG. 1.

An embodiment of the invention is shown in FIGS. 1 through 8. In this embodiment, the hair dryer comprises a main body 3 consisting of a body portion 1 and a hair-winding attachment 2. Body portion 1 is shaped like a cylinder and provided with a revolving electrical connector 4 on the central part of the rear end thereof from which an electrical power cord 5 extends. Air suction holes 6 are provided at the periphery of the revolving connector 4. An airflow guide 7 for air drawn into the hair dryer through air suction holes 6 is located inward of air suction holes 6 in body portion 1. Motor support 8 to which an electric motor 9 is secured is provided inward of airflow guide 7 in body portion 1. Fan 10 is fitted on the shaft of electric motor 9 between motor 9 and airflow guide 7. A rectifier 11 is secured to the side of motor support 8 near the front end of body portion 1, i.e., inward of motor support 8 in body portion 1, and a heater 13 with thermo-switch 12 and a switch 14 are provided between rectifier 11 and the front end of body portion 1, these elements being connected in the usual manner. A mouthpiece 15 to which hair-winding attachment 2 is fixed is provided on the front end of said body portion 1. Hair-winding attachment 2 comprises a cylindrical metallic body 2*a* and a bristle foundation 2*b*. Cylindrical body 2*a* is provided along its length with air blowing holes 16 which decrease sequentially in size from the mouth piece 15 to the free or tip end of hair-winding attachment 2. Associated with each air blowing hole 16 is an air rectifier tab 17 which extends obliquely and inwardly from the end of its respective air blowing hole which is furthest from mouthpiece 15 toward the axis of cylindrical hair-winding attachment 2. It is possible to form these tabs 17 and their associated air blowing holes 16 by cutting one end and two sides of an air blowing hole 6 from cylindrical body 2*a* and bending the flap so formed inwardly, trimming as appropriate. The tab 17 also decrease in size sequentially from the mouth piece 15 to the free end or tip of the cylindrical hair-winding attachment 2. The tabs 17 serve as air rectifying pieces. They deflect hot air coming from the body portion of the dryer out through their respective air blowing holes 16. The bristle foundation 2*b* tightly envelops the cylindrical body 2*a* and is provided with a multiplicity of radially projecting bristles 18 as well as holes 19, each hole 19 communicating with and fitted to a corresponding air blowing hole 16. A hot air vent part 20 is provided at the tip of hair-winding attachment 2, the hot air vents thereof being controlled by valve 22. Four bimetallic sheets 21 extend inwardly of and around hot air vent part 20 to form valve 22. Each bimetallic sheet 21 has the shape of an isosceles trapezoid and is attached to hot air vent part 20 by its base about which it may flex. The bases of the four bimetallic sheets 21 meet to form a square and in normal operation of the hair dryer (i.e., at normal hot air temperatures for the hair dryer) their sides join to form a truncated pyramid which acts to close the hot air vents of hot air vent part 20. The low expansion rate metal sheet of each of the bimetallic sheets 21 faces the inner surface of cylindrical body 2*a*. Thus, on sufficient heating the bimetallic sheets 21 flex away from another and open the hot air vents of hot air vent part 20. The dimensions and materials of the bimetal sheets 21 of valve 22 are so chosen to effect opening when the air temperature in the hair drying attachment 2 rises to a predetermined abnormal level, which level is less than an excessive level. Further, because under normal operating conditions, the valve 22 is a truncated pyramid with its apex opposing the flow of hot air in the cylindrical hair-winding attachment 2, it acts as an air rectifying piece, deflecting the hot air coming from the body portion of the dryer out through those air blowing holes 16 at the tip of cylindrical hair-winding attachment 2, i.e., along that part of hair-winding attachment 2 approximately commensurate with the length of the truncated pyramid, as measured perpendicularly from its base to its apex. There is thus no need for air rectifying tabs 17 for those air blowing holes 16.

Figure 8:
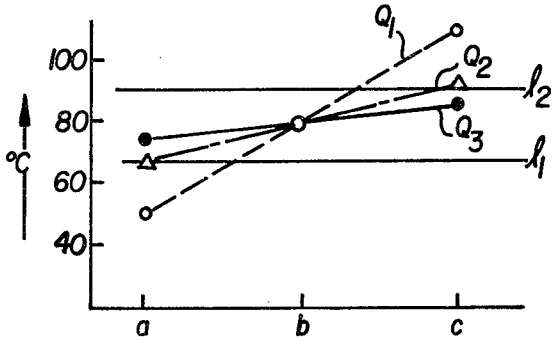
FIG. 8 is a diagram showing the temperature distribution at the air blowing holes of the hair-winding attachment of the hair dryer illustrated in FIG. 1.
Figure 7:
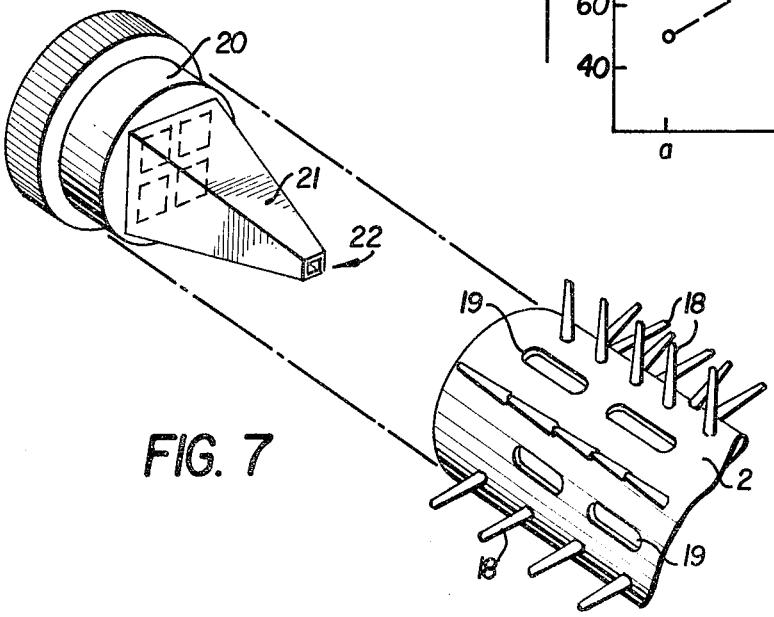
FIG. 7 is an exploded perspective view of the tip portion of the hair-winding attachment of the hair dryer illustrated in FIG. 1.

In operation, cord 5 is inserted into an electrical socket and upon turning on the switch 14, the dryer sucks ambient air through air suction holes 6 with the revolution of the fan 10 actuated by the motor 9 and, at the same time, the heater 13 generates heat. The sucked air, passing by the motor support 8, heater 13, and mouthpiece 15, is guided by tabs 17 of the hair-winding attachment 2 and blown out through air blowing holes 16. Accordingly, on winding hairs around hair-winding attachment 2 and actuating the dryer, hair curling is performed. The temperature distribution of the air blown through the air blowing holes 16 along the entire length of the hair-winding attachment 2 is shown in FIG. 8. In FIG. 8, the ordinate and the abscissa represent temperature and length along the axis of the hair-winding attachment 2. respectively, wherein a, b, and c indicate, respectively, the joint part of hair-winding attachment 2 (i.e., the part joining mouthpiece 15), an intermediate point between the joint part and the free end or tip, and the free end or tip itself. Straight line $Q_1$ indicates the results of measurements conducted on a conventional dryer having air blowing holes which are equal in size to each other whereas $Q_2$ and $Q_3$ represent similar measurements on hair dryers embodying the claimed invention. Lines $1_1$ and $1_2$ represent temperature conditions for hair curling; the zone under line $1_1$ implies weak conditions for curling; that between $1_1$ and $1_2$, moderate ones; and that above $1_2$, strong ones in which the air is felt as quite hot. It can be seen from these results that when air blowing holes 16 and their respective air current rectifying tab pieces 17 decrease sequentially in size from the joint part of hair-winding attachment 2, the temperature difference between the ends of hair-winding attachment 2 is small and the temperatures are within a moderate range, thereby ensuring adequate hair curling along the entire length of hair-winding attachment 2 without any adverse affects.

When the quantity of hair wound around hair-winding attachment 2 is large, closure of the air blowing holes may occur and the air temperature will then rise in the hair-winding attachment 2. When the temperature of the air rises higher than a predetermined maximum, flexure of the bimetal sheets 21 occurs due to the difference in thermal expansion rates of the components of the bimetallic sheets. The bimetallic sheets are, as mentioned, ordinarily joined to form a truncated pyramid, closing the hot air vents of hot air vent part 20. On flexing, these bimetallic sheets separate, thus opening the hot air vents of hot air vent part 20. The hot air is thus vented from the hair dryer before any excessive rise in the air temperature can occur. As a result, the temperature of the air in the hair dryer falls to an appropriate degree in the hair-winding attachment 2, the bimetal sheets of valve 22 return to their initial state and the valve 22 thus closes.

The hair dryer of the claimed invention as described above thus has the following advantages:

(1) Hot air vents are provided in a hot air vent part 20 separately from blowing holes 16 for blowing hot air on hair wound on the hair-winding attachment 2. These hot air vents are controlled by a valve 22 which opens when the air temperature in hair-winding attachment 2 rises to a predetermined abnormal temperature, thus preventing excessive rises of the temperature of the air in hair-winding attachment 2.

(2) The use of bimetal sheets 21 in valve 22 of this embodiment ensures more exact sensing of temperature rise than in an indirect system, permitting simpler structure, as well as exact operation in opening and closing of the valve 22 because of the direct action of the bimetal sheets 21.

(3) Since hot air vent part 20 is provided at the tip of and coaxially with hair-winding attachment 2 around which hairs are wound, hot air blown out through the hot air vents thereof does not directly blow upon the user's skin, thereby ensuring safety.

(4) Since, under normal operating conditions, the bimetal sheets 21 which comprise valve 22 form the shape of a truncated pyramid projecting inwardly along the axis of the hair-winding attachment 2, hot air blown through air blowing holes 16 near the tip of hair-winding attachment 2 can be rectified by valve 22 itself and deflected out those air blowing holes 16, whereby the blowing air current is made uniform in intensity, and thus no air rectifier tabs are required for those air blowing holes 16.

(5) Since air blowing holes 16 as well as air current rectifying tabs 17 decrease in size sequentially as they approach the tip portion of the hair-winding attachment 2, the temperature of hot air blown through air blowing holes 16 is made uniform throughout the entire body of hair-winding attachment 2, that is, without excessive heat at the tip of hair-winding attachment 2, thereby enabling easy handling of the hair dryer.

A second embodiment of the claimed invention is shown in FIG. 9. In this dryer, a bimetal sheet 23 of the same kind as those used in the first embodiment for valve 22 is in this embodiment formed into a bowl-like body whose center is affixed to a projection 24 of the central axis of the hot air vent part 20'. The edge of this blow-like body extends around the hot air vents of hot air vent part 20' so as to close them. The low expansion rate bimetallic sheet component of bimetal sheet 23 faces the inside of hair-winding attachment 2, i.e., faces away from hot air vent part 20'. When the air temperature in hair-winding attachment 2 rises to predetermined abnormal degree, bimetal sheet 23 flexes about its point of attachment, reversing its shape, as shown by the imaginary line and accordingly the hot air vents of hot air vent part 20′ open, venting the hot air and thus avoiding a further rise in air temperature into the excessive range.

A third embodiment of the claimed invention is shown in FIGS. 10 and 11. In this embodiment, valve 22 is composed of a memory alloy piece 25 in the shape of coil and a valve plate 36. Valve plate 26 is secured to the end of the memory alloy piece 25 closest to hot air vent part 20″; this end is free to move in the direction of the axis of hair-winding attachment 2. The other end of memory alloy piece 25 is fixed more inwardly in hair-winding attachment 2. The memory alloy piece 25 is biased so as to resiliently close the air blowing hole 20″ by means of the valve plate 26 and its materials and dimensions so selected as to open the air vent of hot air vent part 20″ by contraction of said coiled alloy piece 25, as shown in FIG. 11, at a deformation point which is previously selected to conform to a predetermined abnormal degree of temperature. In this case, the opening-closing stroke of the valve plate 26 can be made as wide as necessary to enable rapid fall of temperature in hair-winding attachment 2.

What is claimed is:

1. A hair dryer comprising:

a body portion, said body portion including means for drawing in ambient air, means for heating said air so drawn in and means permitting said heated air to be conducted from said body portion in a blowing current; and a cylindrical hair-winding attachment attached by one of its ends to said body portion and adapted to receive said heated air from said body portion, said hair-winding attachment having a series of air blowing holes disposed along its length, said air blowing holes decreasing in size sequentially from its attached end, and a series of air rectifying tabs, each tab associated with one of said air blowing holes, said tabs decreasing in size sequentially from the attached end of said attachment and so disposed with respect to their respective air blowing holes as to deflect the heated air received by said attachment from said body portion out through their respective air blowing holes;

a hot air vent part attached to the other end of said attachment, said part including at least one hot air vent; and a valve for controlling said hot air vent part, said valve disposed inwardly of said part in said attachment and being capable of directly sensing the air temperature in said attachment and to open when said air temperature rises to a predetermined abnormal degree.

2. A hair dryer as in claim 1, wherein said valve comprises four bimetallic sheets in the shape of an isosceles trapezoid, the bases of said trapezoids being joined around the hot air vent of the hot air vent part to form a square, the sides of said trapezoids meeting to form a truncated pyramid at normal operating air temperatures for said hair dryer, the sheet of each said bimetallic sheet having the lower expansion rate with temperature facing the inner surface of said attachment, said bimetal sheets being capable of separating at said predetermined abnormal air temperature to open said hot air vent to vent the abnormally hot air from said hair dryer.

3. A hair dryer as in claim 1, wherein said valve comprises a bowl-shaped bimetallic part, the edge of said bowl-shaped part disposed around the hot air vent of said hot air vent part at normal operating air temperatures for said hair dryer, the low-expansion sheet of said bimetallic sheet facing away from said hot air vent part, said bowl-shaped bimetallic part being capable of reversing its shape at said predetermined abnormal air temperature to open said hot air vent to vent the abnormally hot air from said hair dryer.

4. A hair dryer as in claim 1, wherein said valve comprises a coil of a shape-memory alloy, one end of said coil being fixed in said attachment, the other end being located between said fixed end and said hot air vent part, said other end being free to move in the axial direction of said attachment, said other end having attached thereto a plate, said plate being of such dimensions and so disposed on said other end of said coil and said coil being so biased, that under normal operating temperatures for said dryer, said plate covers said hot air vent, said coil being capable of contracting at said predetermined abnormal air temperature to move said plate away from said hot air vent thus opening said vent to vent the abnormally hot air from said hair dryer.

5. A cylindrical hair-winding attachment for a hair dryer capable of receiving hot air generated by said hair dryer, said hair-winding attachment having a series of air blowing holes disposed along its length, said air blowing holes decreasing in size sequentially from its attaching end, a series of air rectifying tabs, each tab associated with one of said air blowing holes, said tabs decreasing in size sequentially from the attaching end of said attachment and so disposed with respect to their respective air blowing holes so as to deflect the heated air received by said attachment from said body portion out through their respective air blowing holes;

a hot air vent part attached to the other end of said attachment, said part including at least one hot air vent; and a valve for controlling said hot air vent part, said valve disposed inwardly of said part in said attachment and being capable of directly sensing the air temperature in said attachment and opening when said air temperature rises to a predetermined abnormal degree.

6. A cylindrical hair-winding attachment for a hair dryer capable of receiving hot air generated by said hair dryer as in claim 5, wherein said valve comprises four bimetallic sheets in the shape of an isosceles trapezoid, the bases of said trapezoids being joined around the hot air vent of the hot air vent part to form a square, the sides of said trapezoids meeting at normal operating air temperatures for said hair dryer to form a truncated pyramid, the sheet of each said bimetallic sheet having the lower expansion rate with temperature facing the inner surface of said attachment, said bimetal sheets being capable of separating at said predetermined abnormal air temperature to open said hot air vent to vent the abnormally hot air from said hair dryer.

7. A cylindrical hair-winding attachment for a hair dryer capable of receiving hot air generated by said hair dryer as in claim 5, wherein said valve comprises a bowl-shaped bimetallic part, the edge of said bowl-shaped part being disposed around the hot air vent of said hot air vent part at normal operating air temperatures of said hair dryer, the low-expansion sheet of said bimetallic part facing away from said hot air vent part, said bowl-shaped bimetallic part being capable of reversing its shape at said predetermined abnormal air temperature to open said hot air vent to vent the abnormally hot air from said hair dryer.

8. A cylindrical hair-winding attachment for a hair dryer capable of receiving hot air generated by said hair dryer as in claim 5, wherein said valve comprises a coil of a shape-memory alloy, one end of said coil being fixed in said attachment, the other end being located between said end and said hot air vent part, said other end being free to move in the axial direction of said attachment, said other end having attached thereto a plate, said plate being of such dimensions and so disposed on said other end and said coil being so biased, that under normal operating air temperatures for said hair dryer, said plate covers said hot air vent, said coil being capable of contracting at said predetermined abnormal air temperature to move said plate away from said hot air vent thus opening said vent to vent the abnormally hot air from said hair dryer.

* * * * *